United States Patent [19]

Tulli

[11] 4,401,989

[45] Aug. 30, 1983

[54] TELEVISION LINE ANTENNA APPARATUS

[76] Inventor: Telesforo Tulli, 1463 Bath Ave., Brooklyn, N.Y. 11228

[21] Appl. No.: 399,286

[22] Filed: Jul. 19, 1982

Related U.S. Application Data

[63] Continuation of Ser. No. 185,948, Sep. 10, 1980, abandoned.

[51] Int. Cl.[3] ..... H01Q 1/00

[52] U.S. Cl. ..... 343/905; 343/904; 343/861

[58] Field of Search ..... 343/720, 905, 876, 861, 343/904

[56] References Cited

U.S. PATENT DOCUMENTS

| | | | |
|---|---|---|---|
| 2,581,983 | 1/1952 | Thompson | 343/905 |
| 2,666,846 | 1/1954 | Davis | 343/720 |
| 2,925,598 | 2/1960 | Williams | 343/861 |

*Primary Examiner*—David K. Moore

*Attorney, Agent, or Firm*—Dayton R. Stemple

[57] ABSTRACT

Television and FM radio antenna apparatus with a tuneable circuit to be coupled with a building wiring system and thus supplement or replace conventional interior or exterior antennas.

5 Claims, 1 Drawing Figure

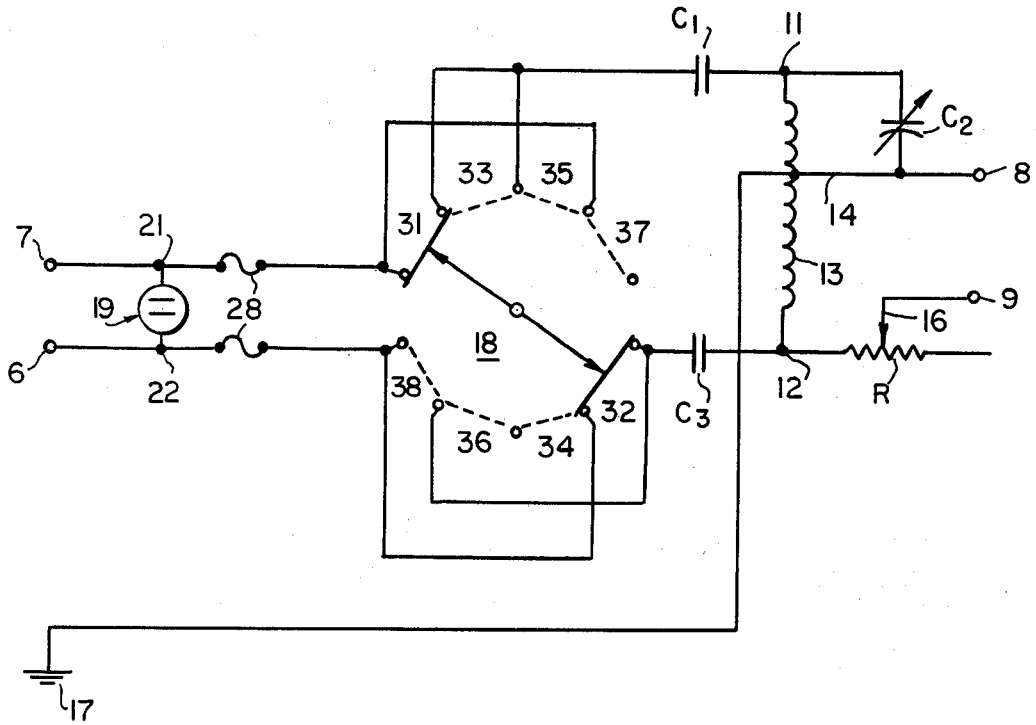
C1
11
C2
8
33
35
31
37
14
7
21
13
19
28
9
16
18
6
22
38
32
C3
12
R
36
34
17

TELEVISION LINE ANTENNA APPARATUS

This is a continuation, of application Ser. No. 185,948, filed Sept. 10, 1980, now abandoned.

BACKGROUND OF THE INVENTION

This invention pertains to antenna apparatus and more particularly to apparatus for coupling the lines of electrical building wiring to the leads of a television or FM radio antenna.

PRIOR ART

In order to get a suitable television signal into a home television set it is necessary to use an antenna. Such antennas generally fall into two classes, exterior or roof antennas, and indoor or interior, e.g., "rabbit ear" antennas. The exterior antennas generally are expensive to purchase and install, require periodic maintenance or replacement, may be dangerous in high winds, affected by the weather conditions as to picture quality, and are visually unattractive. On the other hand, the interior antennas are unattractive, easily broken, dangerous around children, require constant adjustment and are markedly inferior to the exterior antennas.

Throughout the years there have been proposals to solve the problems associated with the above-mentioned antennas by utilizing the building-wiring as the antenna and then coupling the building-wiring to the antenna leads of the television set. Generally, these devices have not become commercial in that they could not satisfactorily receive every available channel.

BRIEF SUMMARY OF THE INVENTION

It is an object of the invention to provide improved antenna apparatus for coupling the building-wiring to the antenna leads of a television or FM radio set wherein such apparatus can selectively make each of the channels available to the television user.

Generally the invention contemplates television line antenna apparatus for coupling the two conductors of a television antenna lead to one or both conductors of the building-wiring circuit. Such apparatus includes a tuneable circuit means having input means and output means connected to the two conductors of the television antenna lead and capacitor coupling means for connecting the input means of the tuneable circuit means to the conductors of the building-wiring circuit.

BRIEF DESCRIPTION OF THE DRAWING

Other objects, the features and advantages of the invention will be apparent from the following detailed description when read in connection with the accompanying drawing, which shows by way of example, and not limitation, the presently preferred embodiments of the invention:

FIG. 1 is a schematic diagram of the preferred embodiment of the invention;

DETAILED DESCRIPTION OF THE EMBODIMENTS OF THE INVENTION

In the Figure, there is shown a coupling apparatus having input terminals 6 and 7 respectively for connection to the terminals of a house line receptacle and output terminals 8 and 9 respectively for connection to the antenna posts on a television receiver. Between these input and output terminals is a tuneable circuit and a capacitor coupling means in the form of coupling capacitors C1 and C3.

More particularly, the tuneable circuit has input means in the form of terminals 11 and 12 and output means connected to the terminals 8 and 9. Connected between the terminals 11 and 12 is an inductor 13 having a tap 14 connected to the terminal 8. The inductor 13 can be a 1.7 microhenry coil with the tap at the 0.4 microhenry point. Connected between the terminal 11 and the tap 14 is a variable capacitor C2. This capacitor, having approximately a value of 100 picofarads, provides part of the tuning for the circuit. Connected between terminals 12 and 9 is a variable resistor R. This resistor is actually a wire wound potentiometer of about 30 ohms and with a two watt capacity. The tap 16 of the potentiometer is connected to the output terminal 9. The input terminals 11 and 12 are respectively connected to the terminals 7 and 6 by means of the coupling capacitors C1 and C3, each of about 500 picofarads. The house lines which go from the terminals 6 and 7 to the receptacle, should preferably be twisted to eliminate noise that may be on the line. A ground lead between tap 14 and the receptacle ground 17 is also helpful in eliminating ground noise.

If the receptacle is of the old type not having a ground connector then a conventional three wire to two wire adaptor can be used with the ground wire of the adaptor being connected to the center screw of the wall plate of the receptacle. However, in certain locations and with certain television receivers, it has been found that a ground lead is not required and a clear picture can be attained just by using the conventional two wire wall receptacle. The coupling capacitors C1 and C3 are basically high pass filters which block out the low frequency 60 cycle line voltage and only permit the passage of the high frequency RF signal of the television transmission.

The 4-way switch 18 controls the signal strength to the receiver. It has been found that with different channels, different positions of the switch are helpful. The tuned circuit tunes the desired channel to resonance and also helps impedance match the line with the receiver. Furthermore, the tuned circuit also improves the picture quality and color and at the same time helps remove ghosts. By using the 4-way switch 18, the apparatus can be modified and simplified in accordance with various conditions in the home wiring system. At position 31, 32, both sides of the house line are in the circuit. At position 33, 34, neither side is in the circuit but only the ground lead 17. Position 37, 38 connects the house line through terminal 6. Similarly, position 35, 36 connects the house line through terminal 7.

Conventional receptacle 19 is an optional feature that may be between the points 21 and 22. The receptacle 19 can then be used for plugging the television set instead of the normal wall outlet for power.

The apparatus can be used when incorporated in a conductor-type housing. In such a case the tap of the inductor 13, one end of the coupling capacitor C2, the terminal 8 and the ground lead 17, are connected to the ground of the chassis and therefore no conventional wiring need be run between those points.

If added safety is desired than small fuses 28, 28 having a current carrying capacity of less than one quarter of an ampere can be inserted between the terminals 6, 7 and the switch 18.

There has thus been shown improved apparatus for coupling the building wiring to the antenna leads of a television or FM radio receiver. This apparatus by providing a unique tuning circuit reduces the noise on the incoming signal, provides better control of the sound, picture and color and is compatible with both vacuum tube and transistor type receivers. In addition, the apparatus can be employed directly into the design of the receiver. Furthermore, it can be used to improve an existing antenna when used in conjunction therewith and in addition can be used without any existing antenna.

While only a limited number of embodiments of the invention have been shown and described in detail, there will now be obvious to those skilled in the art many modifications and variations satisfying many or all of the objects of the invention and without departing from the spirit thereof as defined in the appended claims.

I claim:

1. Antenna apparatus for coupling the two conductors of a television antenna lead to the conductors of a building line comprising:

a tunable circuit, said tunable circuit comprising an inductor having first and second terminals and a tap, a tuning capacitor connected between said first terminal and said tap;

first connecting means for connecting the junction of said first terminal and said tap to one of the conductors of the antenna lead;

second connecting means for connecting said second terminal to the other conductor of the antenna lead;

third connecting means for connecting the junction of said first terminal and said tap to ground;

capacitance coupling means connected to at least one of said terminals; and multiposition manual switching means connected between said capacitance coupling and the conductors of the building, said switching means having a first position for connecting both conductors of the building to said capacitance coupling means, said switching means having second and third positions wherein either one or the other other conductor of the building is connected to said capacitance coupling means.

2. The antenna apparatus of claim 1 wherein the ground is the ground for the building and said switching means has a fourth position wherein neither of the conductors of the building is connected to said capacitance coupling means.

3. The antenna apparatus of claim 1 or 2 wherein said capacitance coupling means comprises first and second high-pass capacitors connected to said first and second terminals respectively of said inductor.

4. The apparatus of claim 3 wherein said second connecting means is a variable resistor.

5. The apparatus of claim 4 wherein said variable resistor is wirewound.

* * * * *